US005260966A

United States Patent [19]

Schottlaender

[11] Patent Number: 5,260,966

[45] Date of Patent: Nov. 9, 1993

[54] REMELTING ARC FURNACE WITH MOVABLE ELECTRODE

[75] Inventor: Peter Schottlaender, Berlin, Fed. Rep. of Germany

[73] Assignee: Leybold Durferrit GmbH, Cologne, Fed. Rep. of Germany

[21] Appl. No.: 936,034

[22] Filed: Aug. 26, 1992

[30] Foreign Application Priority Data

Mar. 13, 1992 [DE] Fed. Rep. of Germany ..... 4207967

[51] Int. Cl.[5] ..... H05B 7/102

[52] U.S. Cl. ..... 373/69; 373/50; 373/52; 373/67; 373/70; 373/100

[58] Field of Search ..... 373/67-69, 373/70, 94-96, 100, 42, 44, 49, 50, 52

[56] References Cited

U.S. PATENT DOCUMENTS

| | | | |
|---|---|---|---|
| 3,379,238 | 4/1968 | Sieckman | 373/70 |
| 3,393,264 | 7/1968 | Wynne | 373/70 |
| 3,393,266 | 7/1968 | Wynne | 373/69 |
| 3,459,868 | 8/1969 | Schlienger | 373/69 |
| 3,614,284 | 10/1971 | Schleidig | 373/69 |
| 4,303,797 | 12/1981 | Roberts | 373/70 |
| 4,357,485 | 11/1982 | Lamarque | 373/95 |
| 4,509,807 | 4/1985 | Reimpell et al. | 373/69 |
| 4,637,032 | 1/1987 | Whitman | 373/69 |
| 4,856,576 | 8/1989 | Peterson | 373/72 |

FOREIGN PATENT DOCUMENTS

| | | |
|---|---|---|
| 0094378 | 12/1985 | European Pat. Off. . |
| 1157739 | 11/1963 | Fed. Rep. of Germany . |
| 1918713 | 12/1970 | Fed. Rep. of Germany . |

*Primary Examiner*—Bruce A. Reynolds
*Assistant Examiner*—Tu Hoang
*Attorney, Agent, or Firm*—Felfe & Lynch

[57] ABSTRACT

A remelting furnace has a crucible (2) and a raisable pot (3) placed thereon. An electrode rod (6) leads into the pot (3) through a stuffing box (8) borne by a lower platform (9). The lower platform (9) is carried by rods (12, 13) which are fastened each at its upper end to a weighing platform (14). The connection of the lower platform (9) to the particular rod (12, 13) is performed in each case through a releasable clutch (10,11 ). Consequently, a lifter (17) can lift the pot (3) such that it shifts upwardly with the bottom platform (9) relative to the rods (12, 13).

3 Claims, 3 Drawing Sheets

REMELTING ARC FURNACE WITH MOVABLE ELECTRODE

BACKGROUND OF THE INVENTION

The invention relates to a remelting furnace having a crucible and a sealed pot placed thereon which is removable from the crucible by a lifter, and having a stuffing box through which an electrode rod serving to hold a consumable electrode passes. The stuffing box is held by a bottom platform suspended on rods from a weighing platform supported by weighing cells on a frame. The electrode rod can be raised and lowered in order to control the melting, and it is held with its electrode driver by the weighing platform.

Remelting furnaces of the above kind are generally known and serve for the production of high-quality metal alloys by the electrical remelting of an electrode in a vacuum by the VAR process. In such remelting furnaces it is necessary to control with the greatest possible accuracy the rate at which the electrode melts, and to feed the electrode rod continuously into the crucible during the melting so that, despite the melting and the rise of the molten metal in the crucible, it will always reach sufficiently far into the crucible. To be able to move the electrode rod into the crucible always to the desired extent, the electrode rod is supported on weighing cells on a weighing platform, so that the weight of the electrode fastened to it can be determined continuously. The bottom platform with the stuffing box is likewise supported by the weighing platform, so that the friction between the electrode rod and the stuffing box will not falsify the weight measurement.

When the crucible is to be recharged, the pot has to be lifted off it by means of the lifter. In the known remelting furnace, the lifter is used to raise an inner frame on which the weighting platform is supported. Thus, when the pot is lifted the entire upper part of the furnace is raised upward with the pot. This increases the structural height of the remelting furnace by the length of movement of the pot, and often this is not possible on account of the overhead crane track which runs above the remelting furnace and is too low to allow this movement. Also, the part of the furnace that has to be lifted is very heavy, so that the lifter must be of sufficiently stable construction and is therefore expensive.

To avoid increasing the structural height, remelting furnaces have been built in which only the pot with the stuffing box is raised instead of the entire upper part of the furnace. To compensate the influence of the friction of the stuffing box on the measured weight of the electrode rod, an additional weight measuring system could be associated with the stuffing box. Such a design would be very complex, however, and therefore it has not been built. In such remelting furnaces, either the friction of the stuffing box was ignored, or else the feed of the electrode rod was controlled not by measuring its weight but by the plunge depth of the electrode rod, i.e., by the change in length of the electrode.

SUMMARY OF THE INVENTION

The invention is addressed to the problem of constructing a remelting furnace of the kind described above. so that a very accurate measurement of the weight of the electrode rod will be made possible with the least complication, without any increase in the structural height of the remelting furnace due to the raising of the pot from the crucible.

This problem is solved according to the invention in that the lifter is disposed between the frame and the pot, and between the bottom platform and the rods a clutch is provided which in the disengaged state permits a relative movement between the rods and the bottom platform.

By this method of construction the bottom platform with the stuffing box is connected to the weighing platform only when the pot is resting on the crucible. For the weight measurement, the stuffing box with the weighing platform constitutes a complete weighing system, so that the friction of the stuffing box does not falsify the measurement. To raise the pot, the connection between the bottom platform and the rods of the weighing platform can be broken, so that the pot can be shifted relative to the frame bearing the weighing platform and the rods carrying the bottom platform during the weighing operation. Thus, the raising of the pot does not increase the structural height of the remelting furnace.

The lifter can be variously constructed and disposed. It is made especially simple if it is formed by a hydraulic jack fastened to the frame with its piston rod attached to the pot.

Any practical clutch design by which a connection of the bottom platform to the rods can be made and released can serve as a clutch. An especially simple embodiment of the clutch is one in which the clutch is formed by bolts disposed on the lower platform and engaging matingly in the engaged state in recesses in the rods holding the bottom platform.

DETAILED DESCRIPTION OF THE PREFERRED EMBODIMENT

Figure 1:
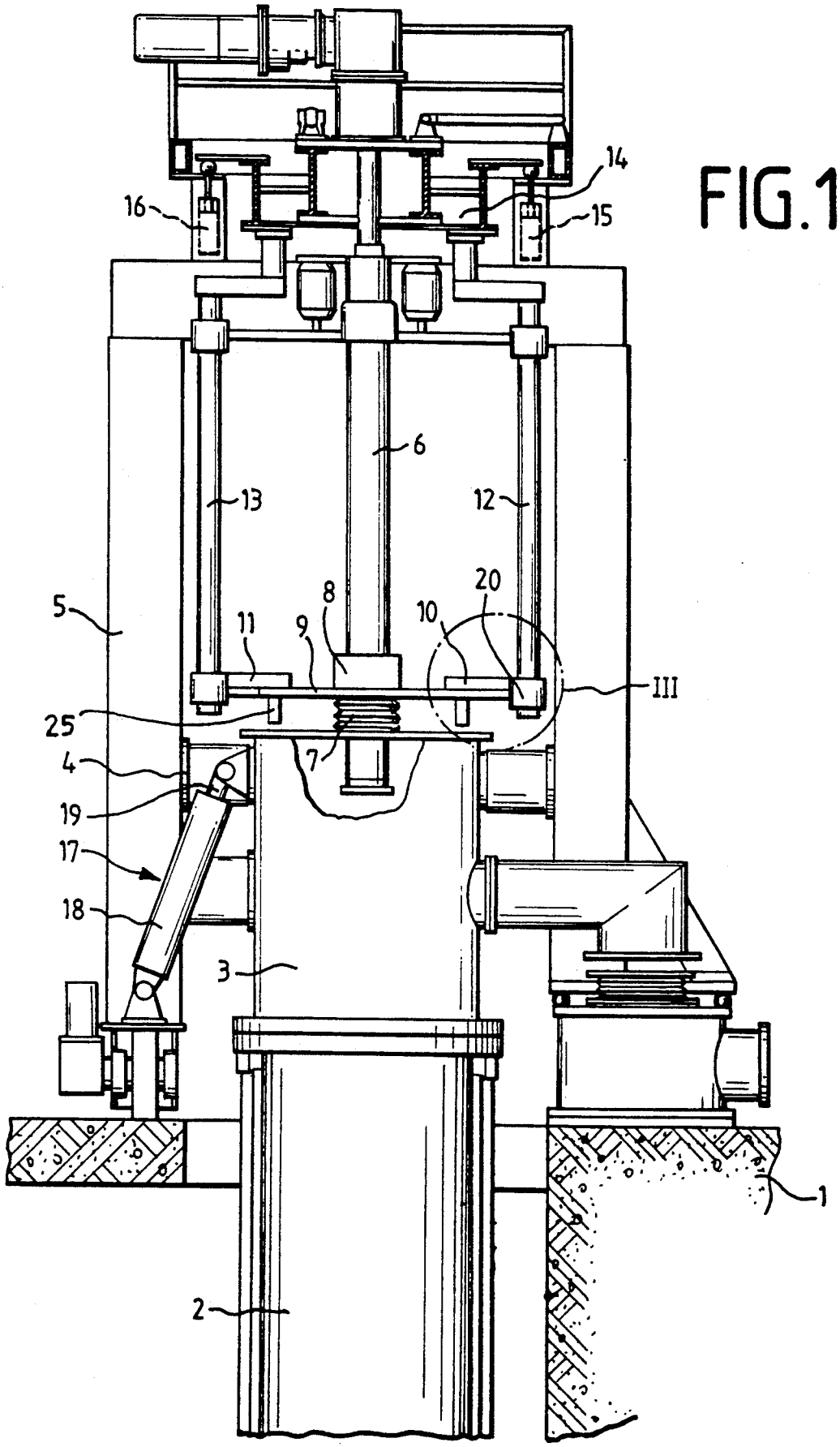
FIG. 1 is a diagrammatic longitudinal section through a remelting furnace according to the invention with a pot superimposed on its crucible.

The remelting furnace represented as a whole in FIG. 1 has a crucible 2 set into a foundation 1, and a pot 3 is sealingly placed on top of it. This pot 3 can be raised upward by a linear guide 4 in a frame 5 straddling the crucible 2 and configured as a rotating frame, so that the pot can be lifted off from the crucible 2. An electrode rod 6 bearing a consumable electrode (not represented) reaches downward into the pot 3.

A stuffing box 8 which is held by a lower platform 9 disposed above the top of the pot and is joined to the top side of the pot 3 through a spring bellows 7 serves to seal the pot 3 in the area where the electrode rod 6 passes through. For this purpose the lower platform 9 is joined by releasable clutches 10 and 11 to guide rods 12 and 13 which in turn are fastened at their upper end to a weighing platform 14 which is supported on the frame 5 from underneath by weighing cells 15 and 16.

In the position of the pot 3 shown in FIG. 1, in which it rests on the crucible 2, the clutches 10 and 11 are closed, so that the lower platform 9 is locked to the guide rods 12 and 13, and therefore forms a closed weight measuring system with the weighing platform 14. Therefore, the weight of an electrode (not shown) hanging from the electrode rod 6 can be measured by the weighing cells 15 and 16 uninfluenced by friction from the stuffing box 8.

The lifting of the pot 3 from the crucible 2 is performed by a lifter 17. This consists of a hydraulic jack 18 which is fastened to the frame 5 and a piston rod 19 reaches out of it to the upper end of the pot 3. If the pot is to be raised by this lifter 17, the clutches 10 and 11 must first be released, so that the pot 3 contacts the spacers 25 on the lower platform 9 and raises it upward between the rods 12 and 13.

Figure 2:
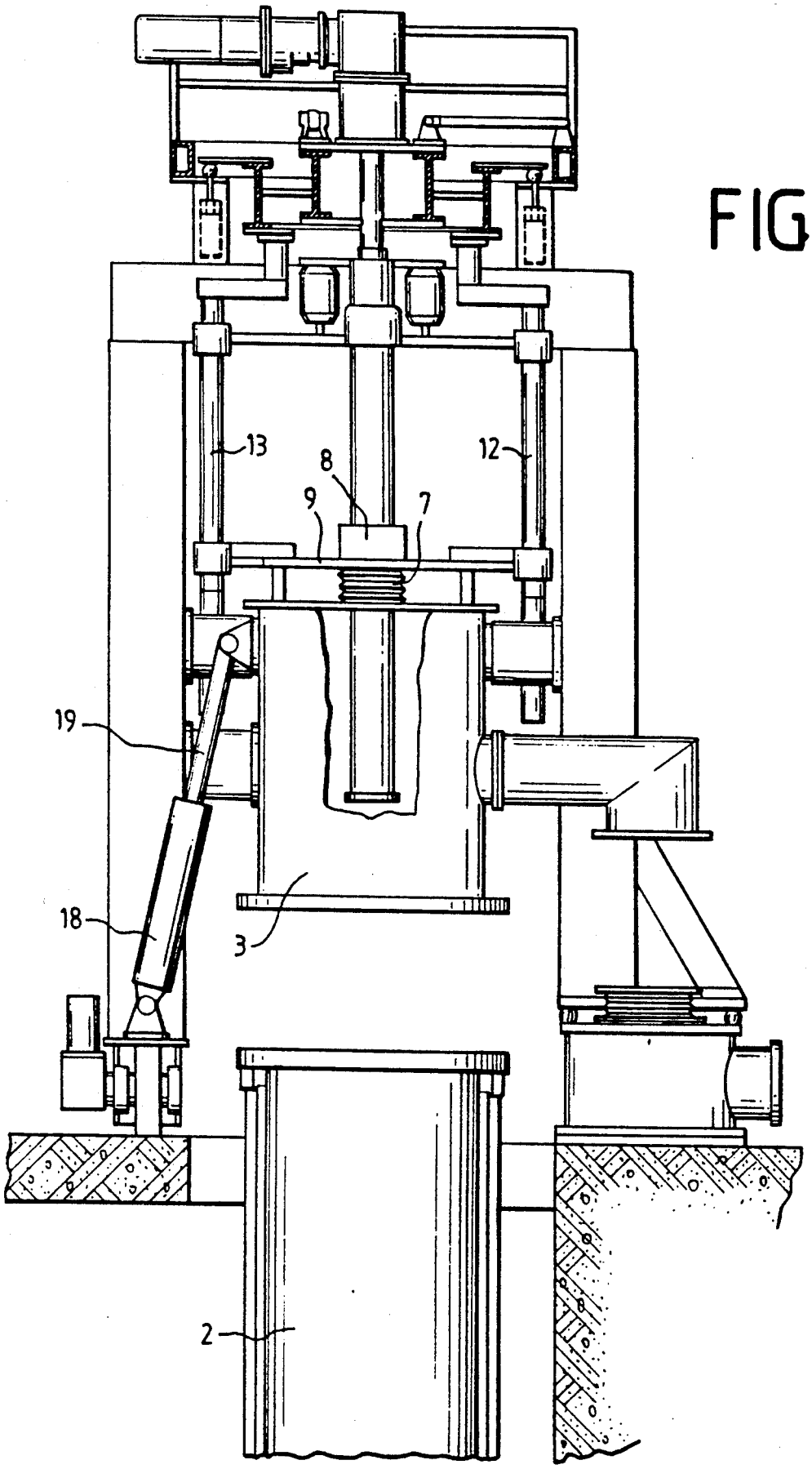
FIG. 2 shows the remelting furnace of FIG. 1 with the pot lifted away from the crucible.

In FIG. 2 the pot 3 is represented in its uppermost position. It can be seen that for this purpose the piston rod 19 has extended far out of the jack 18 and that the bottom platform 9 has moved upward with the pot 3 between the rods 12 and 13.

Figure 3:
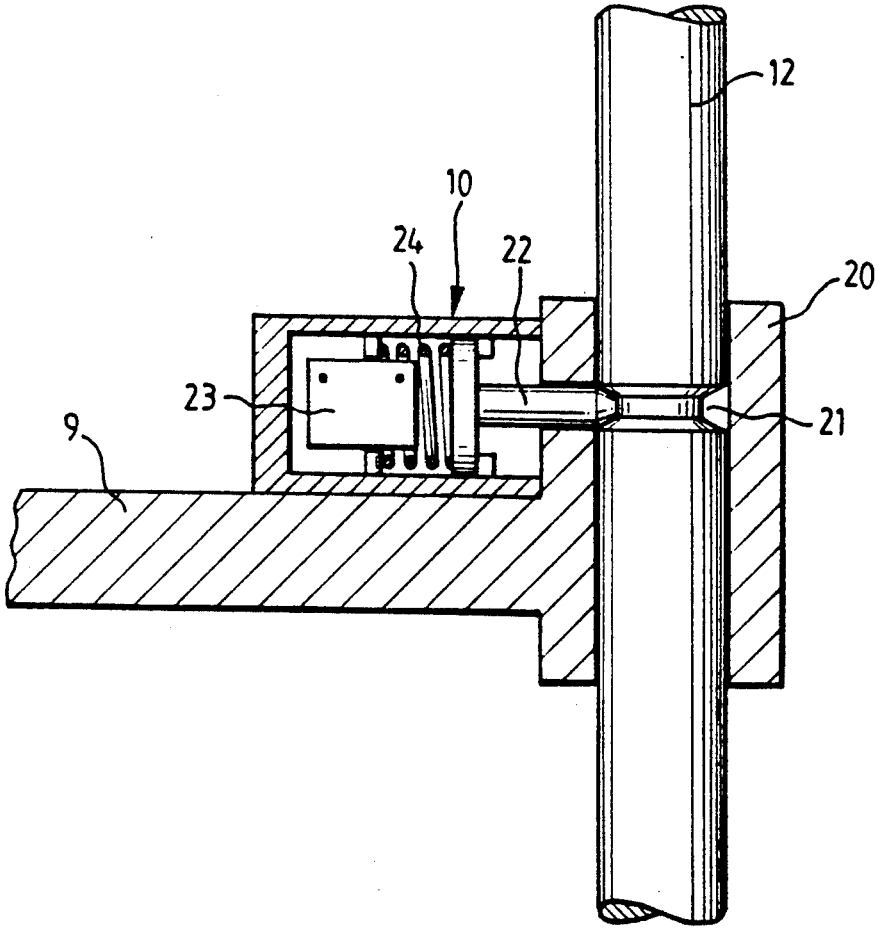
FIG. 3 shows on a larger scale than FIG. 1 of a portion of the remelting furnace identified by the numeral III in FIG. 1.

An example of the configuration of the clutch 10 is represented in FIG. 3. Shown is a right-hand portion of the bottom platform 9 and a portion of the rod 12 which is held by a guiding cylinder 20 of the bottom platform 9. The rod 12 has a recess 21 formed by a circumferential groove, which is engaged by a bolt 22 of the clutch 10. By powering a solenoid actuator 23 the bolt 22 can be withdrawn from the recess 21 against the force of a spring 24. If in the same manner the opposite clutch 11 indicated in FIG. 1 has also been released, the bottom platform 9 can be shifted upward, so that an upward lifting of the pot 3 becomes possible.

I claim:

1. Furnace for melting an electrode, comprising a frame, a weighing platform supported by weighing cells on said frame, electrode drive means on said weighing platform for raising and lowering an electrode rod relative to said weighing platform, said electrode rod serving to bear said electrode, a pair of guide rods suspended from said weighing platform, a lower platform having a passage for receiving said electrode rod therethrough, and sealing means for sealing said electrode rod in said passage, said lower platform being slideable vertically on said guide rods, a crucible fixed with respect to said frame, a pot which fits on top of said crucible and receives said electrode rod therethrough, said pot being situated below said lower platform, lift means for lifting said pot relative to said frame, and clutch means for engaging said lower platform to at least one of said guide rods and disengaging said lower platform from said at least one of said guide rods so that said pot and said lower platform are lifted as a unit relative to said guide rods when said clutch means is disengaged and said lift means lifts said pot, and so that said lower platform is isolated from said pot when said clutch means is engaged and said pot is on top of said crucible.

2. Furnace as in claim 1 wherein said lift means comprises a hydraulic jack fastened to said frame, said jack having a piston rod which engages said pot.

3. Furnace as in claim 1 wherein said clutch means comprises a pair of bolts slideably mounted in said lower platform and a pair of recesses in the respective guide rods, said clutch means being engaged by sliding said bolts matingly into respective recesses.

* * * * *